US007845996B2

(12) United States Patent
Bushman

(10) Patent No.: US 7,845,996 B2
(45) **Date of Patent: *Dec. 7, 2010**

(54) JET PUMP TAIL CONE INSERT

(76) Inventor: Timothy Edward Bushman, 250 Coleen St., Livermore, CA (US) 94550

( * ) Notice: Subject to any disclaimer, the term of this patent is extended or adjusted under 35 U.S.C. 154(b) by 36 days.

This patent is subject to a terminal disclaimer.

(21) Appl. No.: 12/075,006

(22) Filed: Mar. 7, 2008

(65) Prior Publication Data

US 2008/0214066 A1 Sep. 4, 2008

Related U.S. Application Data

(63) Continuation of application No. 11/365,786, filed on Feb. 28, 2006, now Pat. No. 7,357,685.

(60) Provisional application No. 60/667,225, filed on Mar. 31, 2005.

(51) Int. Cl.
*B63H 11/00* (2006.01)
*B63H 11/10* (2006.01)
*B63H 11/103* (2006.01)

(52) U.S. Cl. ..... 440/38; 440/47

(58) Field of Classification Search ..... 440/38, 440/40–43, 46, 47, 66, 67, 71, 72; 416/245 R, 416/245 A, 244 B, 247 R, 247 A; 239/265.19
See application file for complete search history.

(56) References Cited

U.S. PATENT DOCUMENTS

| | | | | |
|---|---|---|---|---|
| 2,641,104 | A | 6/1953 | Estabrook | |
| D325,916 | S | 5/1992 | Lanier | |
| 5,135,358 | A | 8/1992 | Myers | |
| 6,224,434 | B1 | 5/2001 | Varney et al. | |
| 7,048,510 | B2 | 5/2006 | Hedlumd | |
| 7,357,685 | B2 * | 4/2008 | Bushman | 440/38 |

FOREIGN PATENT DOCUMENTS

JP 01262290 A 10/1989

OTHER PUBLICATIONS

Green, Kenneth, "TBM Racing Inc.'s US Pat. No. 7,357,685" letter to M. Dergosits dated Jul. 9, 2008.

* cited by examiner

*Primary Examiner*—Ajay Vasudeva

(57) ABSTRACT

The present disclosure relates to a jet pump tail cone insert for a jet pump. The jet pump tail cone insert comprises a cap, a body and an end member. The end member has a plurality of projections configured to matingly receive a plurality of forks of the body. When connected together, the body and the end member have a plurality of receivers configured to receive stator vanes of a bearing hub of the jet pump. The body and the end member are configured to be proximate the stator vanes. The cap is configured to matingly couple to the body. The jet pump tail cone insert encompasses a portion of the bearing hub of the jet pump. The jet pump tail cone insert occupies within the bearing hub thereby increasing a flow rate of water through the jet pump.

9 Claims, 5 Drawing Sheets

JET PUMP TAIL CONE INSERT

PRIORITY STATEMENT

This application is a continuation of and claims priority to U.S. application Ser. No. 11/365,786, entitled "Jet Pump Tail Cone Insert" filed on Feb. 28, 2006, which claims priority to U.S. Provisional Application No. 60/667,225, entitled "Jet Pump Tail Cone Insert" filed on Mar. 31, 2005, the disclosures of which are incorporated herein by reference in their entirety.

BACKGROUND

The present invention relates to jet pumps, and more particularly, it relates to increasing the efficiency of jet pumps.

Personal water crafts, such as JET SKIS® and the like, are known in the art. Personal water crafts utilize an engine that drives an impeller to transfer water through the drive system, thus propelling the personal water crafts. Standard personal water crafts can travel at speeds of about 35 miles per hour (mph), while high performance personal water crafts can travel at speeds of about 80 mph. However, high performance personal water crafts and their accompanying parts are expensive. Standard jet pumps utilized in standard personal water crafts are inefficient, transferring too much water through a large opening, thus minimizing the performance and speed of the personal water crafts.

In the converse, frequently the jet pump becomes "unloaded" because of the absence of available water to maintain the loaded state of the jet pump. This results in the jet pump being inefficient and minimizes performance.

What is needed in the art is a device that can increase the efficiency of a standard jet pump without redesigning the existing jet pump.

SUMMARY

The following presents a simplified summary of the present invention in order to provide a basic understanding of some aspects of the present invention. This summary is not an extensive overview of the present invention. It is not intended to identify key or critical elements of the present invention or to delineate the scope of the present invention. Its sole purpose is to present some concepts of the present invention in a simplified form as a prelude to the more detailed description that is presented herein.

The present disclosure relates to a jet pump tail cone insert for a jet pump. The jet pump tail cone insert comprises a cap, a body and an end member. The end member has a plurality of projections configured to matingly receive a plurality of forks of the body. When connected together, the body and the end member have a plurality of receivers configured to receive stator vanes of a bearing hub of the jet pump. The body and the end member are configured to be proximate the stator vanes. The cap is configured to matingly couple to the body. The jet pump tail cone insert encompasses a portion of the bearing hub of the jet pump. The jet pump tail cone insert occupies within the bearing hub thereby increasing a flow rate of water through the jet pump.

The disclosure is directed toward a method of decreasing a flow area within a jet pump. The method comprises disposing a jet pump tail cone insert encompassing a portion of a bearing hub of the jet pump. The jet pump tail cone insert includes an end member having an interior and an exterior, an upper portion and a lower portion, a plurality of projections configured to matingly receive a plurality of forks, and a plurality of receivers configured to receive at least one stator vane of the bearing hub. The jet pump tail cone insert includes a body having an interior and an exterior, an upper portion and a lower portion, said plurality of forks configured to matingly attach to the plurality of projections, and a plurality of receivers configured to receive the at least one stator vane of the jet pump. The body is configured to be physically positioned about the stator vanes and the lower portion of the body is configured to matingly couple to the upper portion of the end member. The jet pump tail cone insert includes a cap having an interior and an exterior and an upper portion and a lower portion. The lower portion of the cap is configured to matingly couple to the upper portion of the body. The method the jet pump tail cone insert occupies space proximate the bearing hub thereby increasing a flow rate of water through the jet pump. The flow rate of the water increases the internal pressure within the jet pump.

The disclosure is directed toward a jet pump tail cone insert for a jet pump. The jet pump tail cone insert comprises an end member having an interior and an exterior, an upper portion and a lower portion, a plurality of projections configured to matingly receive a plurality of forks, and a plurality of receivers configured to receive at least one stator vane of a bearing hub of the jet pump. The jet pump tail cone insert also comprises a body having an interior and an exterior, an upper portion and a lower portion, the plurality of forks configured to matingly attach to the plurality of projections of the end member, and a plurality of receivers configured to receive the at least one stator vane of the bearing hub. The body is configured to be proximate the at least one stator vane, with the lower portion of the body configured to matingly couple to the upper portion of the end member. The jet pump tail cone insert also comprises a cap having an interior and an exterior and an upper portion and a lower portion, in which the lower portion of the cap is configured to matingly couple to the upper portion of the body. The jet pump tail cone insert encompasses a portion of the bearing hub of the jet pump.

The jet pump tail cone insert further comprises at least one fastener disposed in at least one groove in the cap. The at least one fastener extends through the cap, the body, and into at least one coupling in the end member. The fastener is configured to securely couple the cap to the body and the body to the end member.

The present invention discloses that the number of forks, the number of projections, and the number of receivers is dependent upon the number of stator vanes in the jet pump. The jet pump tail cone insert occupies space proximate the bearing hub thereby increasing a flow rate of water through the jet pump.

The disclosure is directed toward a method of installing a jet pump tail cone insert in a jet pump. The method comprises disposing an end member proximate at least one stator vane of a bearing hub opposite an exterior side of an impeller of the jet pump. The end member has an interior and an exterior, an upper portion and a lower portion, a plurality of projections configured to matingly receive a plurality of forks, and a plurality of receivers configured to receive the at least one stator vane. The method further comprises matingly coupling a body to the upper portion of the end member. The body has an interior and an exterior, an upper portion and a lower portion, the plurality of forks configured to matingly attach to the plurality of projections of the end member, and the plurality of receivers configured to receive the at least one stator vane of the bearing hub. The body is configured to be physically positioned proximate the at least one stator vane. The method also comprises matingly coupling a cap of the jet pump tail cone insert to the upper portion of the body. The cap having an interior and an exterior and an upper portion and a lower portion.

The method further comprises disposing at least one fastener to extend through the cap, through the body, and into at least one coupling in the end member. The fastener is configured to securely couple the cap to the body and the body to the end member.

The method also discloses attaching the cap, the body, and the end member together with at least one interior locking mechanism.

The method also discloses the number of forks, the number of projections, and the number of receivers is dependent upon the number of stator vanes in the bearing hub. The jet pump tail cone insert occupies space proximate the bearing hub thereby increasing a flow rate of water through the jet pump, wherein the flow rate of the water increases the internal pressure within the jet pump.

BRIEF DESCRIPTION OF THE FIGURES

Referring now to the figures, wherein like elements are numbered alike.

DETAILED DESCRIPTION

Persons of ordinary skill in the art will realize that the following disclosure is illustrative only and not in any way limiting. Other embodiments of the invention will readily suggest themselves to such skilled persons having the benefit of this disclosure.

In a conventional craft using a conventional jet pump, water enters the suction inlet (or intake cavity) of the craft and is forced towards the jet pump. The engine turns a shaft that operates an impeller that pulls water in and forces water towards the rear of the craft. This flow of water propels the craft through the water and provides a means to steer the craft. In the jet pump, the water flows through the impeller into the next cavity (i.e., the bearing hub). The water entering the next cavity is turbulent. In order to propel and steer the craft, the water must be directed and "straightened." Conventional jet pumps have stator vanes to straighten the flow of water. The water is forced through the stator vanes and out of the craft through the exit nozzle.

The present invention is a jet pump tail cone insert. The intention of the jet pump tail cone insert is to enlarge the center diameter of the jet pump bearing hub. This increases pump pressure which results in better efficiency of the pump. The method of installation includes a three-piece design that is retained by the original mounting holes for the bearing end cone. The jet pump tail cone insert is completely removable. The dimensions of the jet pump tail cone insert are specific to each jet pump model. The diameter of the insert increases if the inside diameter of the pump increases. With an increase of horsepower in the motors, the stock pump becomes inefficient which makes a pump modification necessary. The jet pump tail cone insert part allows the customer to utilize the stock pump rather than replacing it with an expensive after-market jet pump.

The present invention transforms the inefficient original equipment manufactured (OEM) pump into a high performance race pump. The hub diameter of the OEM pump has been increased, which creates an increase in pump pressure keeping the pump "loaded" in rough water conditions. The increased efficiency adds amazing acceleration, improved handling and top speed.

Figure 1:
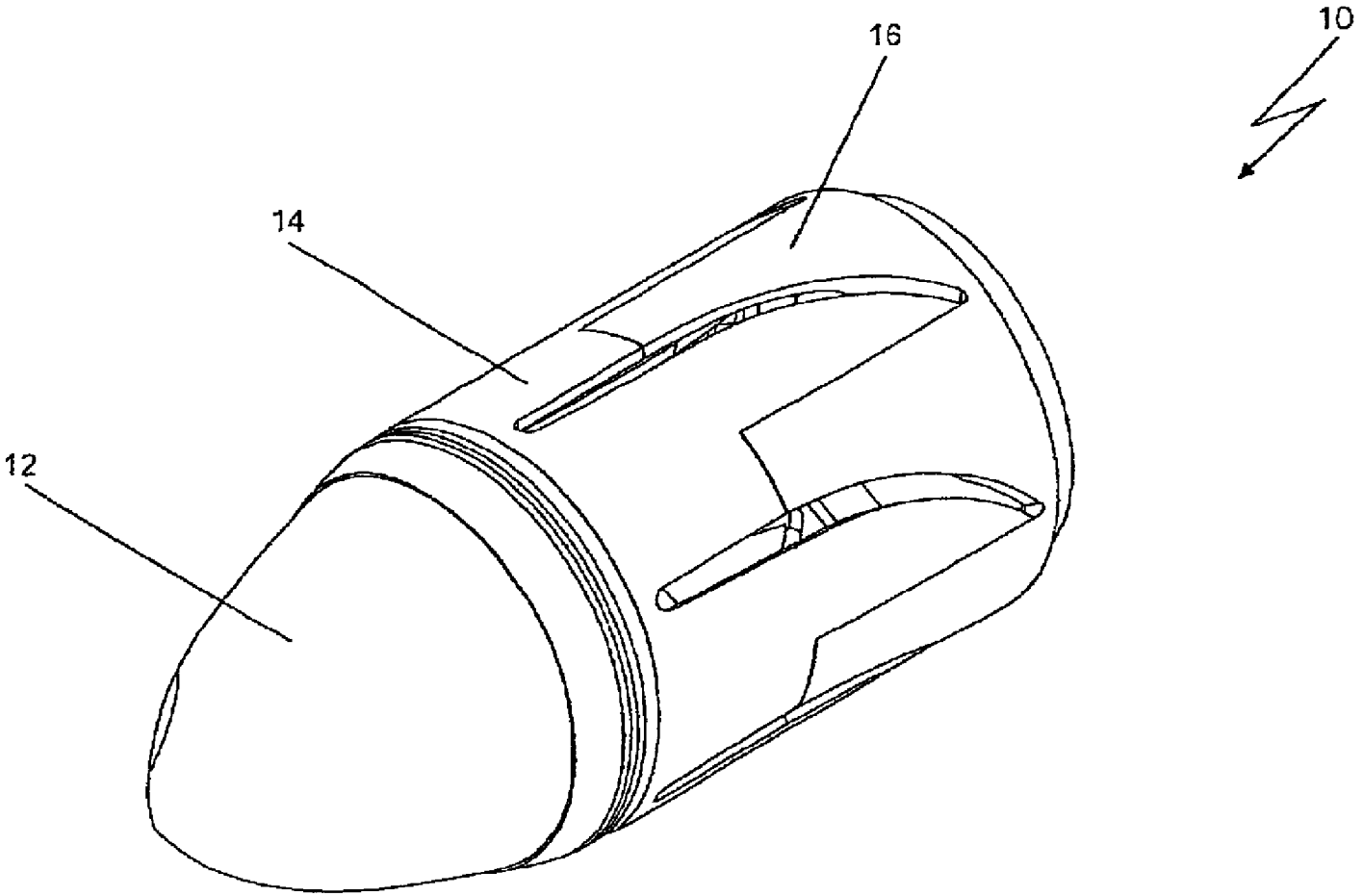
FIG. 1 is a perspective view of an exemplary embodiment of a jet pump tail cone insert.
Figure 2:
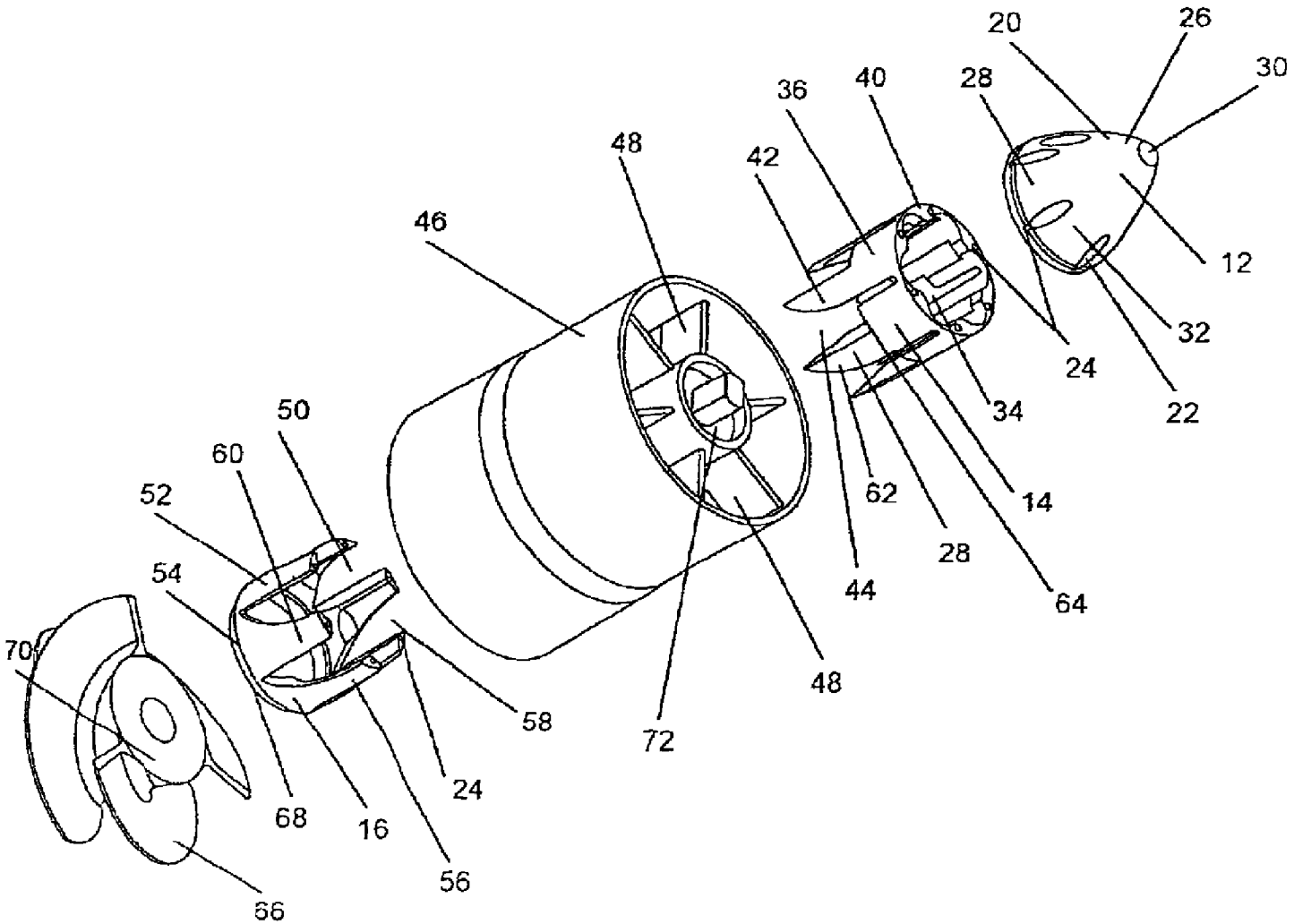
FIG. 2 is a perspective exploded view of elements of an exemplary embodiment of a jet pump tail cone insert as positioned to be installed in a jet pump.
Figure 3:
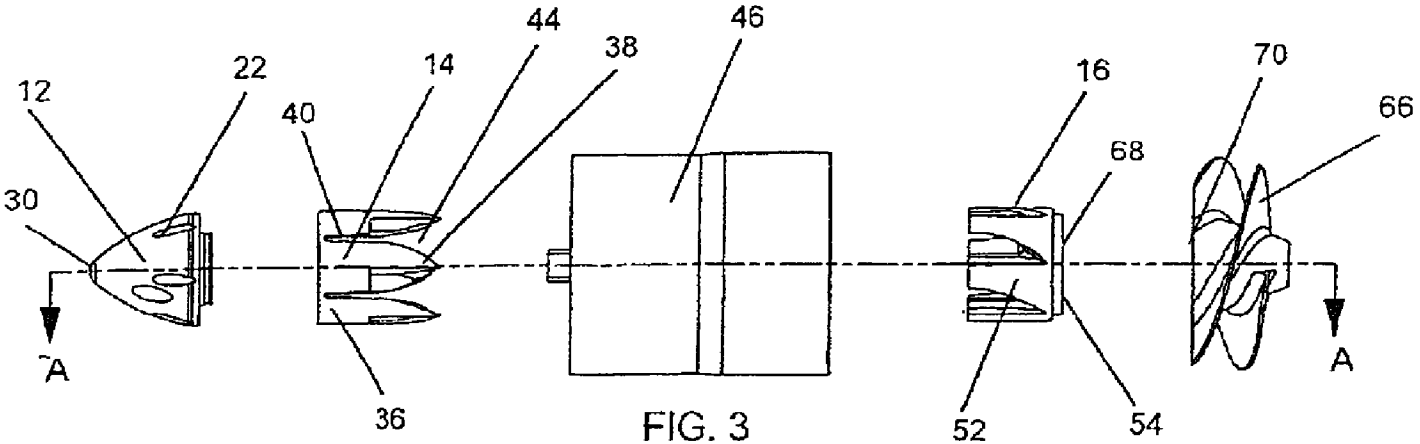
FIG. 3 is a side exploded view of elements of an exemplary embodiment of a jet pump tail cone insert as positioned to be installed in a jet pump.
Figure 4:
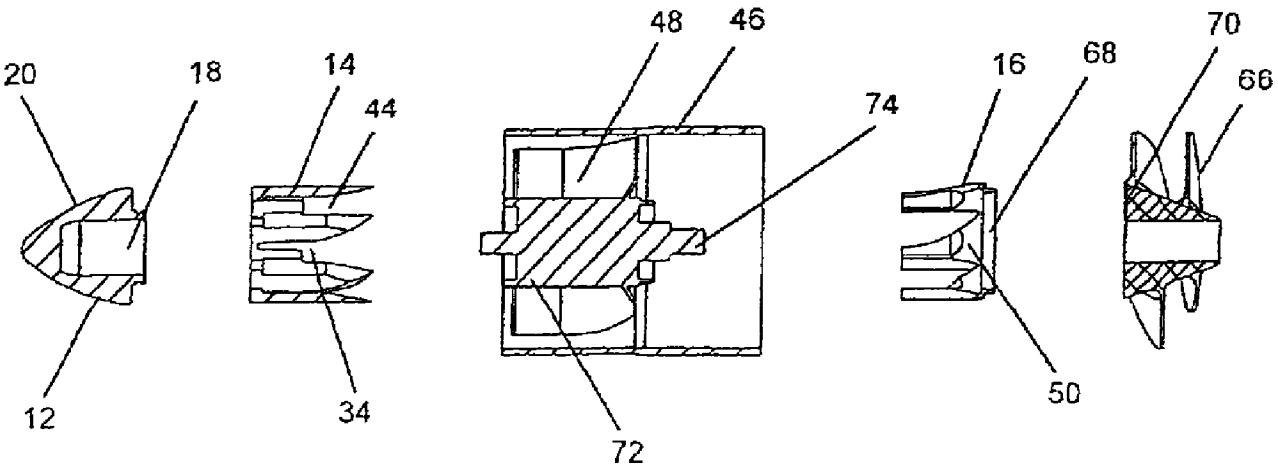
FIG. 4 is a cross section of the exploded view of elements of an exemplary embodiment of a jet pump tail cone insert as positioned to be installed in a jet pump taken along line A of FIG. 3.

Referring to FIGS. 1, 2, 3, and 4, an exemplary jet pump tail cone insert 10 is illustrated assembled (FIG. 1) and disassembled (FIGS. 2, 3, 4). The jet pump tail cone insert 10 is installed within the jet pump 46, as will be illustrated and described further herein. Specifically, FIG. 2 illustrates an exploded perspective view of the jet pump tail cone insert 10 and jet pump 46 disassembled. FIG. 3 is a side view perspective view of the jet pump tail cone insert 10 and jet pump 46 disassembled. FIG. 4 is a cross section of the jet pump tail cone insert 10 and jet pump 46 disassembled taken along line A of FIG. 3.

The jet pump tail cone insert 10 includes a cap 12, a body 14 and an end member 16. In one embodiment, the cap 12 has an interior portion 18 opposite an exterior portion 20. The cap 12 can be hollow or solid. Disposed on the exterior portion 20 are grooves 22 having passages 24 that are configured to receive a fastener. The passages 24 extend through the cap 12 to allow a fastener to couple the cap 12 with the body 14. The cap 12 has an upper portion 26 opposite a lower portion 28. The upper portion 26 has a peak 30 extending to a wider portion 32 while the upper portion 26 has a smaller diameter than the wider portion 32. The lower portion 28 is configured to matingly sit within the inside diameter of the body 14. The cap 12 is attached to the body 14 using fasteners, as explained further herein.

Although a cone or dome shape is illustrated for the cap 12, any shape is contemplated, including square, polygon, rounded, and the like. However, a cone shape is preferred since the water will flow over the jet pump tail cone insert 10 to the exit nozzle (not shown). The preferred shape is any shape that allows for the flow of water over the jet pump tail cone insert 10, while providing the necessary change in flow area through the jet pump 46.

Several attachment means are contemplated in order to construct the jet pump tail cone insert 10 and hold the separate portions together. The cap 12 can be attached to the body 14 and the end member 16 depending upon the types of jet pumps to which it is installed. In the preferred embodiment, the separate pieces of the jet pump tail cone insert 10 can be coupled together using fasteners such as screws, bolts, latches, nails, pins, and the like. In another embodiment, the separate pieces of the jet pump tail cone insert 10 can be coupled together using an interior locking mechanism such as rivets, snaps, hooks, clamps, and the like. The attachment means utilized is designed so as to not protrude from the surface of the jet pump tail cone insert 10, in order to have a low flow resistance of water over the jet pump tail cone insert 10.

The body 14 has an interior portion 34 opposite an exterior portion 36 and a lower portion 38 opposite an upper portion 40. The upper portion 40 is configured to matingly receive the wider portion 32 and the lower portion 28 of the cap 12. The body 14 has elliptical shaped forks 42 that extend from the lower portion 28. The forks 42 have a varying thickness and taper dependent upon the draft angle of the pump housing. The thickness of the forks is dependent upon the diameter of the hub portion of the pump housing. Although a curved design is illustrated, the forks can be of any shape, as long as the forks can be received by the end member 16 and can fit within the spaces between the stator vanes 48. The fastener will be disposed through the upper portion 40 through passages 24 of the body 14. The body 14 has openings 44 configured to receive stator vanes 48 of a jet pump 46 as illustrated in FIGS. 2, 3, and 4. The forks 42 are configured to mount about the stator vanes 48 and be in physical contact with the stator vanes 48. The body 14 surrounds and encompasses a portion of the stator vanes 48 of the pump 46. The forks 42 are configured to matingly couple to the end member 16. In another embodiment, the forks 42 are not in physical contact with the stator vanes 48.

The end member 16 has an interior portion 50 opposite an exterior portion 52 and a lower portion 54 opposite an upper portion 56. The upper portion 56 is configured to matingly receive the forks 42 of the body 14. The upper portion 56 has openings 58 that are configured to receive the top portion 62 of forks 42. The end member 16 has partitions 60 that are shaped to matingly couple to the upper portion 62 and lower portions 64 of the forks 42. The fastener will extend from the top of the partition 60 through passages 24 through to the end member 16 to the bottom portion 54. The bottom portion 54 of the end member 16 can have a diameter less than or equal to the upper portion 56, depending upon the size of the jet pump impeller 66. The end member 16 is matingly coupled to the impeller 66 of the jet pump 46. The end member 16 is configured to mount about and be in physical contact with the stator vanes 48.

Both the body 14 and the end member 16 have a circular shape, although any shape is contemplated including square, polygon, rounded, and the like. However, a circular shape is preferred since the water will flow over the jet pump tail cone insert 10.

In a preferred embodiment, the jet pump tail cone insert 10 can be comprised of three separate parts that are joined together, as described above. It is contemplated that in other designs, more than three separate pieces may be required in order to fulfill the purpose of the jet pump tail cone insert 10. The cap 12, the body 14 and the end member 16 matingly couple to each other. The jet pump tail cone insert 10 may not be water tight. However, the jet pump tail cone insert 10 is designed to fit snuggly to the bearing hub and stator vanes in order to prevent the flow of water between the jet pump tail cone insert 10 and the stator vanes.

As illustrated in FIGS. 2, 3, and 4, the body 14 and the end member 16 are designed to accommodate any number of stator vanes 48 disposed in the jet pump 46. The end member 16 is configured to fit inside the exterior side 70 of the impeller 66. The end member 16 can be designed with an insertable lip 68 that fits inside the exterior side 70 of the impeller 66. Other attachment means are contemplated and depend upon the size and type of the jet pump. The end member 16 does not interface with the impeller 66.

The body 14 and the end member 16 are configured to insert around the stator vanes 48, thus increasing the diameter of the bearing hub 72. The impeller 66 attaches to the bearing hub 72 via the driveshaft (or impeller shaft) 74. Although a jet pump 46 having six stator vanes 48 is illustrated and the jet pump tail cone insert 10 is designed to accommodate this jet pump 46, the present invention is contemplated for use in jet pumps having from about three stator vanes to about sixteen stator vanes. It is contemplated that the jet pump tail cone insert 10 can be designed by one skilled in the art to accommodate any size and type jet pump, with any number of stator vanes.

The jet pump tail cone insert 10, and accompanying parts described herein, can be comprised on any material that can tolerate the presence of water and the force of the water rushing through the jet pump. Some materials include aluminum (such as 6061 billet aluminum), stainless steel, plastic, rubber, fiberglass, composite, or a number of other available materials. As long as the finished part retains its structural integrity, there is no specific material that this design is limited to. As with the many material options there are also many manufacturing options as well, such as computer numerical control (CNC) machining, sand casting, investment casting, die casting, permanent molding, extruding, injection molding, vacuum forming, and the like.

As indicated above, the dimensions of the jet pump tail cone insert 10 are specific to each jet pump model. The diameter of the insert increases if the inside diameter of the jet pump increases. A preferred overall diameter of the jet pump tail cone insert 10 can be about 70 millimeters (mm) to about 80 mm, with about 73 mm to about 75 mm preferred.

Figure 5:
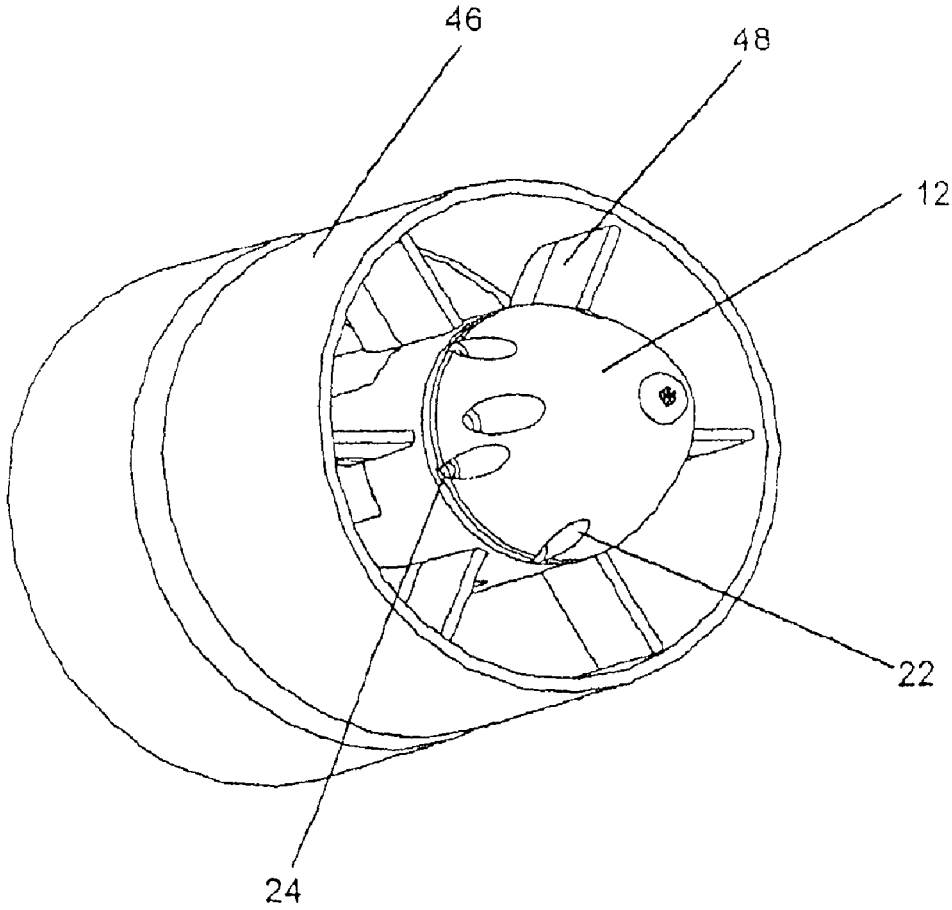
FIG. 5 is a perspective rear view of an exemplary embodiment of a jet pump tail cone insert installed in a jet pump.
Figure 7:
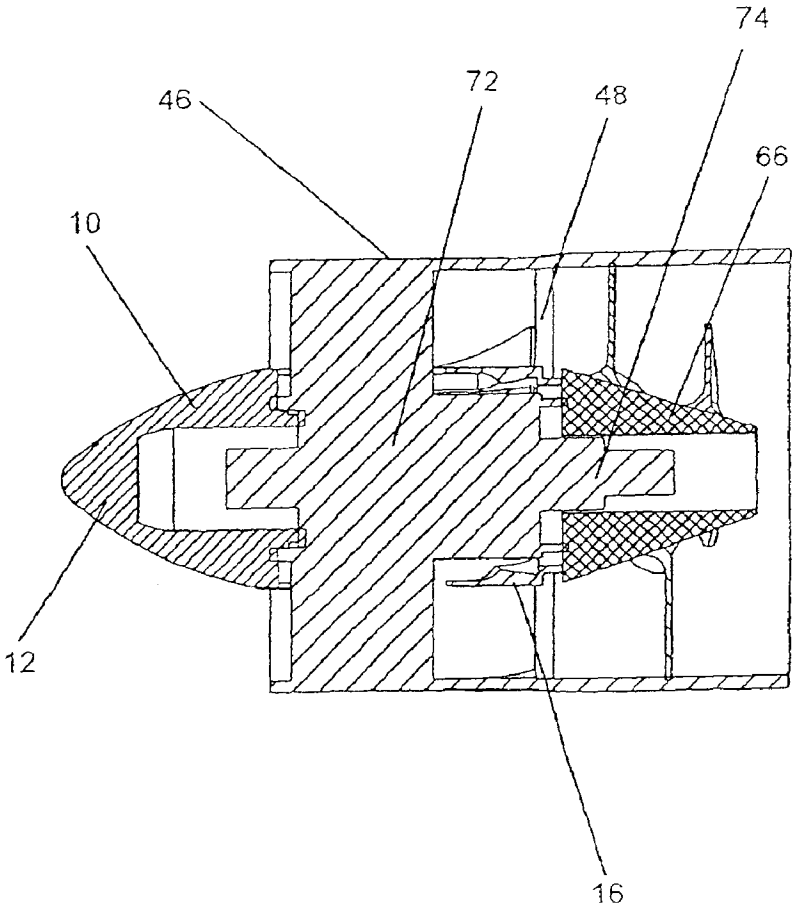
FIG. 7 is a cross section of an exemplary embodiment of a jet pump tail come insert installed in a jet pump taken along line B of FIG. 6.
Figure 6:
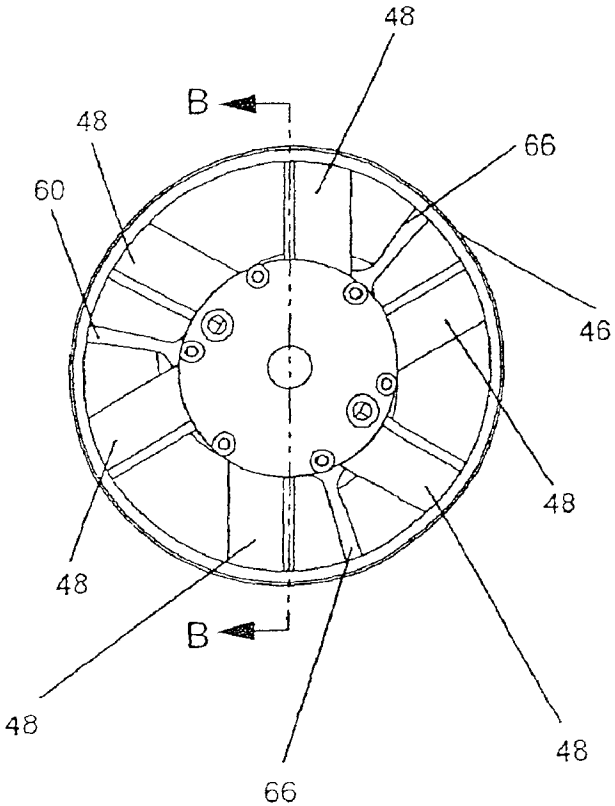
FIG. 6 is a perspective top view of an exemplary embodiment of a jet pump tail cone insert installed in a jet pump.

FIGS. 5, 6, and 7 illustrate the jet pump tail cone insert 10 installed in a jet pump 46. FIG. 5 illustrates a rear view of the jet pump tail cone insert 10 installed in a jet pump 46. FIG. 6 is a frontal view of the impeller and jet pump tail cone insert 10 installed in a jet pump 46 FIG. 7 is a cross section of the jet pump tail cone insert 10 installed in a jet pump 46 taken along line B of FIG. 6.

The jet pump tail cone insert 10 is very easily installed in a jet pump 46. The end member 16 is positioned to physically encompass and couple to the stator vanes 48 in the jet pump 46. The end member 16 does not physically attach to the impeller 66. The impeller 66, and attached end member 16 are disposed onto the drive shaft 74 such that the impeller 66 is physically coupled to the bearing hub 72 of the jet pump 46. The body 14 is positioned to fit about the stator vanes 48, physically encompassing the stator vanes 48, and matingly attaches to the end member 16. The cap 12 is then matingly coupled to the body 14. A fastener is threaded through the three pieces (i.e., the cap 12, the body 14, and the end member 16) of the jet pump tail cone insert 10; securing the pieces together and holding the jet pump tail cone insert 10 onto the jet pump 46.

By installing the jet pump tail cone insert 10, the efficiency of the jet pump 46 is increased since the center diameter of the stator vane bearing hub 72 is enlarged. The principle of this is to increase the internal pump pressure which causes the pump to stay "loaded" with water for a longer period of time than is possible using only the standard configuration of the bearing hub. In increasing the internal pressure there is an increase in the vacuum effect that the jet pump maintains with the surface of the water. Additional benefits are improved handling characteristics due to the personal water craft "gripping" the water more effectively.

The present invention can be used in any jet propulsion device and is not intended to be limited to personal watercraft. The present invention increases the efficiency of an original equipment pump preventing the need for expensive tooling changes.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention.

What is claimed is:

1. A jet pump tail cone insert for a jet pump comprising:

an end member having an end member interior and an end member exterior opposite said interior, an end member upper portion and an end member lower portion opposite said end member upper portion, a plurality of projections configured to matingly receive a plurality of forks, and a plurality of receivers configured to receive at least one stator vane of a bearing hub of the jet pump;

a body having a body interior and a body exterior opposite said body interior, a body upper portion and a body lower portion opposite said body upper portion, said body having said plurality of forks configured to matingly attach to said plurality of projections of said end member, and a plurality of receivers configured to receive said at least one stator vane of said bearing hub, said body is configured to be proximate said at least one stator vane, said body lower portion configured to matingly couple to said end member upper portion;

a cap having a cap interior and a cap exterior opposite said cap interior and a cap upper portion and a cap lower portion opposite said cap upper portion, said cap lower portion configured to matingly couple to said body upper portion; and at least one fastener disposed in at least one groove in said cap, said at least one fastener extending through said cap, through said body, and into at least one coupling in said end member, said fastener configured to securely couple said cap to said body and said body to said end member, wherein the jet pump tail cone insert occupies space proximate said bearing hub thereby increasing a flow rate of water through the jet pump.

2. The jet pump tail cone insert of claim 1, wherein said cap, said body and said end member are attached together with at least one interior locking mechanism.

3. The jet pump tail cone insert of claim 1, wherein the number of said forks, the number of said projections, and the number of said receivers is dependent upon the number of said stator vanes in said jet pump.

4. The jet pump tail cone insert of claim 1, wherein said end member upper portion includes openings configured to receive a top portion of said forks; and wherein said end member comprises partitions configured to matingly couple to said forks.

5. The jet pump tail cone insert of claim 1, wherein the jet pump tail cone insert is not water tight.

6. The jet pump tail cone insert of claim 1, wherein said end member is configured to mount about and be in physical communication with said at least one stator vane.

7. The jet pump tail cone insert of claim 1, wherein said cap has a cone shape.

8. The jet pump tail cone insert of claim 1, wherein said end member is coupled to an impeller of the jet pump.

9. The jet pump tail cone insert of claim 1, wherein said cap is shaped to be at least one of square, polygon, and rounded.

* * * * *